US005774768A

United States Patent [19]

Hazama et al.

[11] Patent Number: 5,774,768

[45] Date of Patent: Jun. 30, 1998

[54] IMAGE-FORMING APPARATUS AND IMAGE-FORMING UNIT

[75] Inventors: Hiroyuki Hazama; Masaru Watanabe; Takashi Terada; Hirotsugu Ogawa, all of Chuo-ku, Japan

[73] Assignee: Mita Industrial Co., Ltd., Osaka, Japan

[21] Appl. No.: 820,354

[22] Filed: Mar. 12, 1997

[30] Foreign Application Priority Data

Mar. 13, 1996 [JP] Japan ..... 8-056243

[51] Int. Cl.[6] ..... G03G 15/02

[52] U.S. Cl. ..... 399/170; 399/125; 399/171; 399/172

[58] Field of Search ..... 399/170, 171, 399/172, 111, 115, 148, 149, 150; 250/324, 325

[56] References Cited

U.S. PATENT DOCUMENTS

| | | | |
|---|---|---|---|
| 4,087,170 | 5/1978 | Sawaoka et al. | 399/148 |
| 4,920,380 | 4/1990 | Ueda et al. | 399/171 |
| 5,221,946 | 6/1993 | Kohyama | 399/150 |
| 5,227,841 | 7/1993 | Takahashi et al. | 399/111 |
| 5,283,618 | 2/1994 | Hosoya et al. | 399/150 |
| 5,294,961 | 3/1994 | Ohtaka et al. | 399/170 X |
| 5,300,979 | 4/1994 | Tsukakoshi et al. | 399/111 |

*Primary Examiner*—Arthur T. Grimley
*Assistant Examiner*—Hoan Tran
*Attorney, Agent, or Firm*—Sherman and Shalloway

[57] ABSTRACT

An image-forming apparatus for forming image through the electric charging of a photosensitive material drum, exposure to light, developing and transfer, wherein a developing device also works to clean the toner remaining on the photosensitive material; an electric charge for effecting the electric charging has a scorotron charger located within ±45° from a perpendicular downwardly drawn from the center of the photosensitive material drum, and has a hole on the side opposite to the opening for charging; and an electric field $E_1$ between a wire and a grid in the scorotron charger is set to be stronger than an electric field $E_2$ between the wire and a shield. The invention is further concerned with an image-forming unit used in the image-forming apparatus for forming image wherein said image-forming unit includes a photosensitive material drum having a photosensitive layer of an organic material, a first frame for supporting the photosensitive material drum maintaining the freedom of rotation, a photosensitive material unit having a scorotron charger which is provided on the first frame so as to be positioned within ±45° from a perpendicular downwardly drawn from the center of the photosensitive material drum and has a ventilation hole on the side opposite to the opening for charging, a developing device, and a second frame which supports the developing device and also works as a toner container; wherein the first frame and the second frame have a common fulcrum and a resiliently engaging device on the side opposite to the fulcrum, and an electric field $E_1$ between a wire and a grid in the scorotron charger is set to be stronger than an electric field $E_2$ between the wire and a shield.

11 Claims, 6 Drawing Sheets

IMAGE-FORMING APPARATUS AND IMAGE-FORMING UNIT

BACKGROUND OF THE INVENTION 1. (Field of the Invention)

The present invention relates to an image-forming apparatus of an electrophotographic type. More specifically, the invention relates to an image-forming apparatus which permits the photosensitive material to be little affected by the discharge-formed products and enables the steps of the electrophotography to be carried out stably and smoothly over extended periods of time despite the apparatus as a whole is fabricated in a very compact size.

2. (Prior Art)

According to the electrophotographic system, a photosensitive material is electrically charged and exposed to light to form an electrostatic latent image, the electrostatic latent image on the photosensitive material is then developed with a developing agent containing a charging toner to form a toner image which is then transferred onto a transfer material such as paper or the like, and the transferred toner image is fixed thereby to form an image.

Known examples of the photosensitive material for electrophotography include selenium photosensitive material, α-silicon photosensitive material, organic photosensitive material and the like photosensitive materials. Among them, however, an organic photosensitive material is preferred from the standpoint of cost of production, easy disposal, friendliness to the environment, and adaptability to small copying machines, facsimiles and printers.

The organic photosensitive materials can be divided into a single-layer organic photosensitive material in which a charge-generating agent (CGM) is dispersed in a medium which contains a charge-transporting agent (CTM), and a laminated-layer photosensitive material in which a charge-transporting layer (CTL) is formed on a charge-generating layer (CGL).

The photosensitive materials are usually electrically charged by a corona-charging system involving, however, a problem in regard to generating the discharge-formed products such as ozone, NOx, etc. That is, the latter laminated-layer photosensitive material must be negatively charged and, hence, generates ozone in large amounts. On the other hand, the former single-layer photosensitive material must be positively charged and generates ozone in amounts smaller than that of the latter photosensitive material but generates NOx.

In the facsimiles, printers and small copying machines, it becomes essential to decrease the diameter of the photosensitive material drum in order to realize the image-forming apparatus in a compact size and in a reduced weight. However, a decrease in the diameter of the drum is accompanied by the occurrence of various troubles.

First, in the electrically charging portion of the photosensitive material drum, ozone and NOx generate due to the corona discharge. When the drum has a small diameter, the whole drum surface is subject to be exposed to the ozone atmosphere. Besides, since the drum has a small surface area, a piece of copy image is formed through a plural number of turns. Therefore, the photosensitive material tends to be deteriorated with ozone within relatively short periods of operation time.

As the diameter of the drum is decreased, i.e., as the peripheral length of the drum is decreased, furthermore, limitation is imposed on the mechanisms arranged surrounding the photosensitive drum, i.e., limitation is imposed on the mechanisms for executing the steps of the electrophotography; e.g., space becomes not enough for arranging the mechanisms for executing the above-mentioned steps.

A system has heretofore been proposed according to which the photosensitive material is electrically charged and is exposed to image light after the toner has been transferred thereto without cleaning the toner remaining on the surface of the photosensitive material, and the remaining toner is cleaned in the step of developing. This cleaningless developing system may be desirable for the image-forming apparatus that uses a drum of a small diameter accompanied, however, by a problem in that the residual toner after the transfer scatters and adheres onto the charging device to impair the charging performance.

SUMMARY OF THE INVENTION

The object of the present invention, therefore is to provide an image-forming apparatus which permits the photosensitive material to be little affected by the discharge-formed products and enables the steps of the electrophotography to be carried out stably and smoothly over extended periods of time despite the apparatus as a whole is fabricated in a compact size.

Another object of the present invention is to provide a compact image-forming apparatus which permits the photosensitive material to be less deteriorated by ozone and NOx, and permits the photosensitive material to be electrically charged maintaining stability over extended periods of time, as well as to provide an image-forming unit used for this image-forming apparatus.

According to the present invention, there is provided an image-forming apparatus for forming image through electric charging of a photosensitive material drum, exposure to light, developing and transfer, wherein means for developing also works to clean a toner remaining on the photosensitive material;

means for electric charging is a scorotron charger which is located within ±45° from a perpendicular downwardly drawn from the center of the photosensitive material drum, and has a hole on the side opposite to the opening for charging; and an electric field $E_1$ between a wire and a grid in said scorotron charger is set to be stronger than an electric field $E_2$ between the wire and a shield.

The photosensitive material drum used in the present invention:

1. is provided with a photosensitive layer of an organic material;
2. has a single-layer dispersion-type organic photosensitive layer and, particularly, has a positively-charging organic photosensitive layer containing at least a charge-generating material and a charge-transporting material in a binder resin; and
3. is a drum of a small diameter with a circumferential length shorter than one-half the image size in the direction in which the drum rotates, and forms a piece of copy image after having rotated many times.

The electrically charging means used in the present invention is a scorotron charger having a ventilation hole on the side opposite to the opening for charging, i.e., a charger comprising a shield, a discharge wire contained in the shield and to which a high voltage is applied, a grid provided in the opening for charging, and a ventilation hole formed on the side opposite to the opening for charging, and wherein an electric field $E_1$ between the wire and the grid in the scorotron charger is stronger than an electric field $E_2$ between the wire and the shield.

It is desired that the developing means used in the present invention is a reversal developing means using a one-component-type development agent (toner).

It is desired that the transfer means used in the present invention:

1. is a roller charging means located on the upper side of the photosensitive material; and
2. is a means which transfers the toner image onto the lower surface of the transfer paper by using a charging roller which is not in contact with the photosensitive drum having the toner image.

According to the present invention, furthermore, there is provided an image-forming unit used in an image-forming apparatus for forming image through electric charging of a photosensitive material drum, exposure to light, developing and transfer, and having means for developing which also works to clean the toner remaining on the photosensitive material; wherein said image-forming unit comprises a photosensitive material drum having an organic photosensitive layer, a first frame for supporting the photosensitive material drum maintaining the freedom of rotation, a photosensitive material unit having a scorotron charger which is provided on said first frame so as to be positioned within ±45° from a perpendicular downwardly drawn from the center of the photosensitive material drum and has a ventilation hole on the side opposite to the opening for charging, a developing means, and a second frame which supports said developing means and also works as a toner container; wherein said first frame and said second frame have a common fulcrum and a resiliently engaging means on the side opposite to the fulcrum, and an electric field $E_1$ between a wire and a grid in said scorotron charger is set to be stronger than an electric field $E_2$ between the wire and a shield.

DETAILED DESCRIPTION OF THE INVENTION

Figure 1:
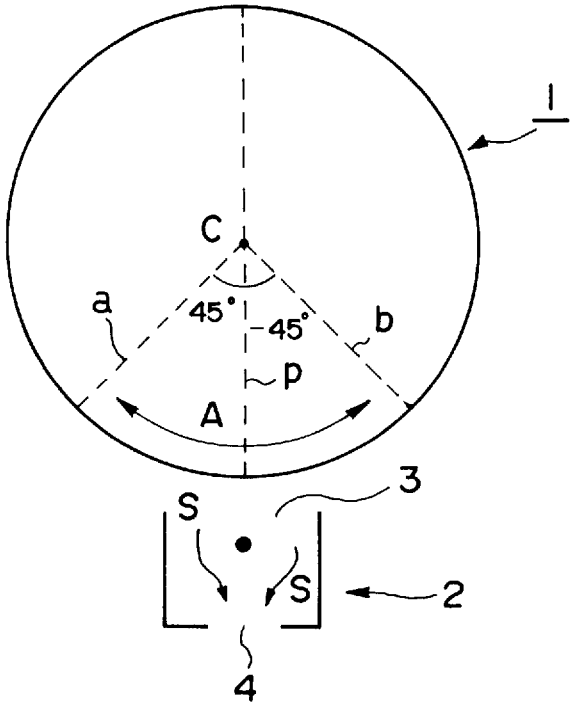
FIG. 1 is a diagram illustrating a relationship of arrangement between a photosensitive material drum and a charging means.

In a main charger in which a corona is generating, discharge-formed products such as ozone, NOx and the like are inevitably formed. In the present invention in which the main charger is positioned at the lower side of the photosensitive material, however, the effects of the discharge-formed products (having specific gravities larger than that of the air) upon the surface of the photosensitive material can be avoided. At the same time, a hole is formed on the side opposite to the opening for charging. Therefore, the discharge-formed products staying in the discharger are permitted to quickly flow down when the formation of image has finished (when the rotation of the photosensitive material drum is discontinued and the charger is turned off). The toner which is constantly falling down is also permitted to flow out through the hole, and the toner is prevented from adhering onto the corona wire or the like members.

When the main charger is provided on the lower side of the photosensitive material and when the drum has a small diameter, the transfer means is positioned on the upper side of the photosensitive material. According to the present invention, however, the transfer means is based on the roller charging instead of the corona charging, and no corona discharge takes place on the upper side of the photosensitive material.

Furthermore, the transfer is effected by the roller charging of the non-contact type. Besides, since the back-surface transfer is employed, the contact between the photosensitive material supporting the toner and the transfer roller is shut off by the paper. Even when the transfer operation is not carried out, the transfer roller is separated away from the photosensitive material which supports the toner. Therefore, the transfer roller is not contaminated and the back surface of the transfer paper is not contaminated, either. This is particularly important when printing on both surfaces of the paper. Besides, by use of the non-contact type roller, the transfer paper is not pushed onto the photosensitive material, and white spots are not formed on the characters and the image quality is markedly improved.

With the transfer means being provided on the upper side of the photosensitive material, the length of the conveyer passage can be minimized between the paper-feeding means placed on the upper part of the apparatus and the printed matter-discharging means, making it possible to fabricate the apparatus in a very compact size.

The photosensitive material drum and the charging means are mounted on a first frame to constitute a photosensitive material unit, the developing means is mounted on a second frame to constitute a developing agent unit, and provision is made of a common fulcrum and a resiliently engaging means for the first frame and for the second frame, so that the developing means and the photosensitive material drum are reliably engaged together. Moreover, the image-forming unit is simply constituted, and can be very easily detached from, or attached to, the apparatus.

The present invention exhibits markedly enhanced effects particularly when the positively-charging type organic photosensitive material is a single-layer dispersion-type organic photosensitive material. That is, employment of the positively-charging type organic photosensitive material makes it possible to use positive corona and, hence, to decrease the generation of ozone compared to when negative corona is used. On the other hand, the organic photosensitive material and, particularly, the single-layer dispersion-type organic photosensitive material is more affected by the discharge-formed products than the inorganic photosensitive materials. According to the present invention, however, the arrangement of the above-mentioned means makes it possible to decrease the effects of the discharge-formed products to a considerable degree.

An electric field $E_1$ between a wire and a grid in the scorotron charger is set to be stronger than an electric field $E_2$ between the wire and a shield, and the efficiency for electrically charging the photosensitive material is improved. That is, a small current (Icc) flows into the charging wire compared to the case of $E_1<E_2$ and, hence, the amount of the discharge-formed products decreases. At the time of charging, furthermore, the fresh air flows in through the hole formed on the side opposite to the opening for charging owing to ion wind which is produced by the electric field, and the air in the charger is quickly substituted with the fresh air.

[Arrangement of Charging Means]

Referring to FIG. 1 illustrating a relationship of arrangement between the photosensitive material drum and the charging means, the charging means 2 is arranged within a range (A) from a line (a) to a line (b), which are ±45° with respect to a perpendicular (P) downwardly drawn from a center (C) of the photosensitive material drum 1.

As will be described later, when the charging means 2 is disposed on the side higher than the line (a) or the line (b), ozone and NOx staying in the charger falls on the photosensitive material drum that is at rest immediately after the formation of the image, causing a local deterioration of the photosensitive material drum, a local drop in the charging potential and a local drop in the sensitivity. When the charging means is disposed in a range (A) defined between the line (a) and the line (b), it is allowed to greatly decrease a local drop in the charging potential or a local drop in the sensitivity.

This is because even when ozone ($O_3$) or NOx are generated by the charging means 2, ozone and NOx having specific gravities (molecular weights) larger than that of the air flow downwards within the above-mentioned range (A), and contact to the photosensitive material is avoided or decreased.

According to the present invention, a hole 4 for ventilation is formed in the charging means 2 on the side opposite to the opening 3 for charging. With the hole 4 being formed, heavy ozone generated by the charger 2 flows down as designated at S, quickly moves away from the photosensitive material body 1, and the effect of ozone upon the photosensitive material 1 further decreases.

In addition, the hole 4 formed in the charger 2 is very effective for the above-mentioned cleaningless electrophotographic system. That is, the toner remaining on the surface of the photosensitive material after the transfer, scatters and adheres onto the corona wire, shield and grid of the charger 2 to adversely affect the charging performance and the stability thereof. According to the apparatus of the present invention in which the hole 4 is formed in the charger 2 on the side opposite to the opening 3 for charging, however, the toner is discharged to the exterior through the opening 3 for charging and the hole 4; i.e., the toner that has scattered do not adhere to the corona wire, shield or grid, and does not adversely affect the charging performance or the stability thereof.

According to the present invention, therefore, the effects of the discharge-formed products upon the photosensitive material decrease, the steps in the electrophotographic method are executed stably and smoothly over extended periods of time, and the photosensitive material is effectively prevented from being deteriorated by ozone despite the apparatus as a whole is fabricated in a compact size.

[Image-Forming Apparatus]

Figure 2:
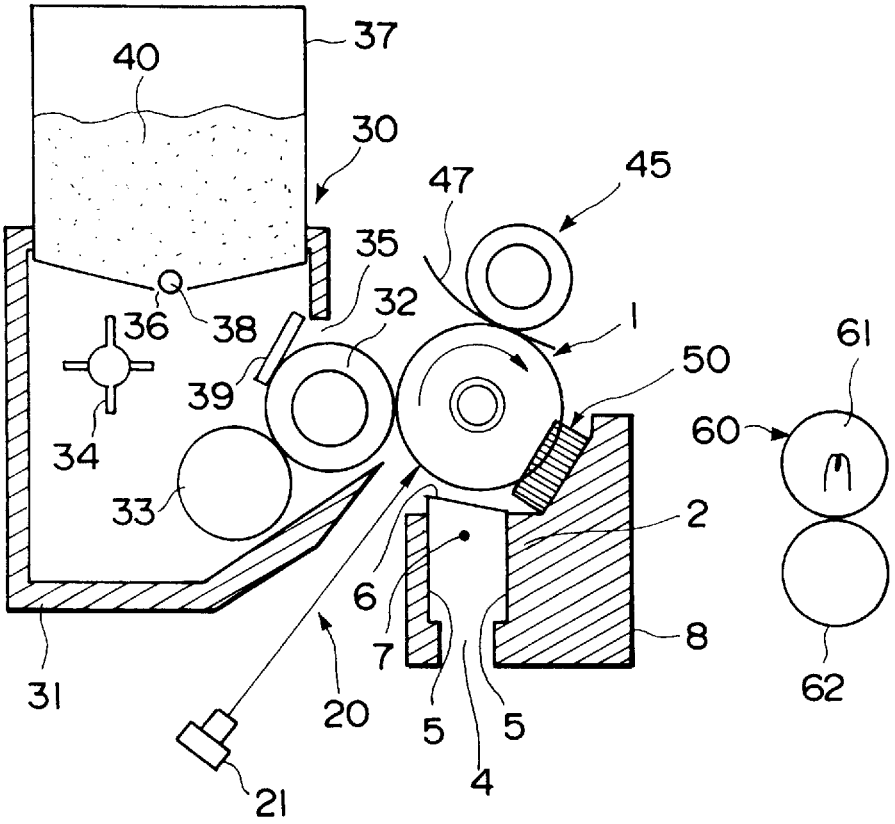
FIG. 2 is a diagram illustrating the whole arrangement of an image-forming apparatus according to the present invention.

Referring to FIG. 2 illustrating the whole arrangement of the image-forming apparatus of the present invention, the photosensitive material drum 1 is surrounded by charger means 2 located at the lowest position, image exposure means 20, developing means 30, toner transfer means 45, and foreign matter-removing means 50 for removing paper dust and the like in the order mentioned. A transfer material 47 is fed from a transfer material feed means (not shown) to between the transfer means 45 and the photosensitive material drum 1, and is discharged to the outer side through a fixing means 60.

Briefly described below are the steps for forming image in-the electrophotographic apparatus.

First, the surface of the photosensitive material drum 1 is electrically charged with electric charge of positive polarity using the charger means 2. Next, the photosensitive material drum 1 that is electrically charged is irradiated with light image in the image exposure means 20 to form an electrostatic latent image (negative image) corresponding to the document image. The electrostatic latent image is visualized by the developing means 30 to form a toner image. The transfer material 47 is so fed as to come into contact with the surface of the drum at a position of the toner transfer means 45, so that the toner image is transferred onto the transfer material 47. The transfer paper 47 onto which the toner image is transferred separates away from the drum 1, sent to the fixing means 60 and is passed through between the support roller 61 and the heater roller 62 so that the toner is fixed. After the toner has been transferred, the photosensitive material drum 1 comes into contact with the foreign matter-removing means 50 where foreign matters such as paper dust and the like are removed. The toner remaining on the photosensitive drum passes through the charging step and the image exposure step, and is cleaned through the developing means 30.

[Photosensitive Material]

There is no particular limitation on the photosensitive material used in the present invention. It is, however, desired that the photosensitive material is a single-layer photosensitive material and, generally, a single-layer organic photosensitive material in which a charge-generating agent is dispersed in a charge-transporting medium and is, particularly, a positively-charging organic photosensitive material. This photosensitive material is particularly effective when it is used in the form of a drum of a small diameter, and is, hence, used in the form of a drum having a diameter as small as 20 mm or less and, particularly, from 10 to 20 mm.

Examples of the charge-generating agent include selenium, selenium-tellurium, amorphous silicon, pyrylium salt, azo pigment, dis-azo pigment, tris-azo pigment, anthanthrone pigment, phthalocyanine pigment, indigo pigment, threne pigment, toluidine pigment, pyrazoline pigment, pyranthrone pigment, perylene pigment, quinacridone pigment and the like pigment, which are used in one kind or being mixed together in two or more kinds so as to possess an absorption wavelength zone in a desired region.

Among them, it is desired to use phthalocyanine pigment, perylene pigment and dis-azo pigment.

As a resin medium for dispersing the charge-generating agent, there can be used a variety of resins, for example olefinic polymers such as styrene polymer, acrylic polymer, styrene/acrylic polymer, ethylene/vinyl acetate copolymer, polypropylene, ionomer and the like, polyvinyl chloride, vinyl chloride/vinyl acetate copolymer, polyester, alkyd resin, polyamide, polyurethane, epoxy resin, polycarbonate, polyacrylate, polyarylate, polysulfone, diallyl phthalate, silicone resin, ketone resin, polyvinylbutylal resin, polyether resin, phenol resin, and photocurable resins such as epoxy-acrylate. These binder resins can be used in one kind or being mixed together in two or more kinds. Preferred examples of the resin include styrene polymer, acrylic polymer, styrene/acrylic polymer, polyester, alkyd resin, polycarbonate, polyarylate, and the like.

A particularly preferred resin may be a polycarbonate, panlite produced by Teijin Kasei Co., PCZ produced by Mitsubishi Gas Kagaku Co., or the like derived from bisphenols represented by the following general formula (1)

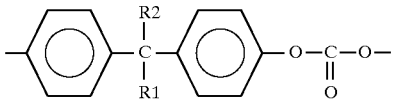

wherein R1 and R2 are hydrogen atoms or lower alkyl groups, and R1 and R2 in combination may form a cyclic ring such as cyclohexane ring together with a carbon atom coupled thereto, and a phosgene.

The charge-transporting agent (CTM) may transport electrons or transport positive holes. Or, these two kinds of charge-transporting agents may be used in combination. Preferred examples are electron attractive substances such as paradiphenoquinone derivatives, benzoquinone derivatives, naphthoquinone derivatives, tetracyanoethylene, tetracyanoquinodimethane, chloroanil, bromoanil, 2,4,7-trinitro-9-fluorenone, 2,4,5,7-tetranitro-9-fluorenone, 2,4,7-trinitro-9-dicyanomethylenefluorenone, 2,4,5,7-tetranitroxanthone, and 2,4,8-trinitrothioxanthone, and these electron attractive substances may be polymerized.

Among them, paradiphenoquinone derivatives and, particularly, asymmetrical paradiphenoquinone derivatives exhibit excellent solubility and excellent electron-transporting property.

A paradiphenoquinone derivative may be represented by the following general formula (2),

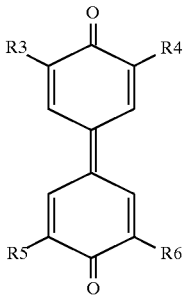

wherein R3, R4, R5 and R6 are each a hydrogen atom, an alkyl group, a cycloalkyl group, an aryl group, an aralkyl group or an alkoxyl group.

It is desired that R3, R4, R5 and R6 are substituents of asymmetrical structure. It is desired that two out of R3, R4, R5 and R6 are lower alkyl groups, and other two are branched-chain alkyl groups, cycloalkyl groups, aryl groups or aralkyl groups.

Though there is no particular limitation, suitable examples include, 3,5-dmethyl-3',5'-di-t-butyldiphenoquinone, 3,5-dimethoxy-3',5'-di-t-butyldiphenoquinone, 3,3'-dimethyl-5,5'-di-t-butyldiphenoquinone, 3,5'-dimethyl-3',5-di-t-butyldiphenoquinone, 3,5,3',5'-tetramethyldiphenoquinone, 2,6,2',6'-tetra-t-butyldiphenoquinone, 3,5,3',5'-tetraphenyldiphenoquinone, 3,5,3',5'tetracyclohexyldiphenoquinone, and the like. These diphenoquinone derivatives are desirable since they have a small intermolecular interaction due to their low of molecules symmetry and exhibit excellent solubility.

As the positive hole-transporting substance, on the other hand, the following compounds have been known. Among them, those compounds having excellent solubility and positive hole-transporting property are used: i.e., pyrene;

carbazoles such as N-ethylcarbazole, N-isopropylcarbazole, N-methyl-N-phenylhydrazino-3-methylidene-9-carbazole, N,N-diphenylhydrazino-3-methylidene-9-ethylcarbazole;

phenothiazines such as N,N-diphenylhydrazino-3-methylidene-10-ethylphenothiazine and the like;

phenoxazines such as N,N-diphenylhydrazino-3-methylidene-10-ethylphenoxazine and the like;

hydrazones such as p-diethylaminobenzaldehyde-N,N-diphenylhydrazone, p-diethylaminobenzaldehyde-α-naphthyl-N-phenylhydrazone, p-pyrrolidinobenzaldehyde-N,N-diphenylhydrazone, 1,3,3-trimethylindolenine-ω-aldehyde-N,N-diphenylhydrazone, p-diethylbenzaldehyde-3-methylbenzthiazolinone-2-hydrazone and the like;

pyrazolines such as 2,5-bis(p-diethylaminophenyl)1,3,4-oxadizole, 1-phenyl-3-(p-diethylaminostyryl)-5-(p-diethylaminophenyl) pyrazoline, 1-[quinonyl(2)]-3-(p-diethylaminostyryl)-5-(p-diethylaminophenyl) pyrazoline, 1-[pyridyl(2)]-3-(p-diethylaminostyryl)-5-(p-diethylaminophenyl) pyrazoline, 1-[6-methoxypyridyl (2)]-3-(p-diethylaminostyryl)-5-(p-diethylaminophenyl) pyrazoline, 1-[pyridyl(3)]-3-(p-diethylaminostyryl)-5-(p-diethylaminophenyl) pyrazoline, 1-[lepidyl(3)]-3-(p-diethylaminostyryl)-5-(p-diethylaminophenyl) pyrazoline, 1-[pyridyl(2)]-3-(p-diethylaminostyryl)-4-methyl-5-(p-diethylaminophenyl) pyrazoline, 1-[pyridyl(2)]-3-(α-methyl-p-diethylaminostyryl)-3-(p-diethylaminophenyl) pyrazoline, 1-phenyl-3-(p-diethylaminostyryl)-4-methyl-5-(p-diethylaminophenyl) pyrazoline and the like;

oxazole compounds such as 2-(p-diethylaminostyryl)-3-diethylaminobenzoxazole, 2-(p-diethylaminophenyl)-4-diethylaminophenyl)-5-(2-chlorophenyl) oxazole and the like;

thiazole compounds such as 2-(p-diethylaminostyryl)-6-diethylaminobenzothiazole and the like;

triarylmethane compounds such as bis(4-diethylamino-2-methylphenyl) phenylmethane and the like;

polyarylalkanes such as 1,1-bis(4-N,N-diethylamino-2-methylphenyl) heptane, 1,1,2,2-tetrakis(4-N,N-dimethylamino-2-methylphenyl) ethane and the like;

benzidine compounds such as N,N'-diphenyl-N,N'bis (methylphenyl) benzidine, N,N'-diphenyl-N,N'-bis (ethylphenyl) benzidine, N,N'-diphenyl-N,N'-bis (propylphenyl) benzidine, N,N'-diphenyl-N,N'-bis (butylphenyl) benzidine, N,N'-bis(isopropylphenyl) benzidine, N,N'-diphenyl-N,N'-bis(secondary butylphenyl) benzidine, N,N'-diphenyl-N,N'-bis (tertiary butylphenyl) benzidine, N,N'-diphenyl-N,N'-bis(2,4-dimethylphenyl) benzidine, N,N'-diphenyl-N,N'-bis(chlorophenyl) benzidine and the like; as well as triphenylamine, poly-N-vinylcarbazole, polyvinylpyrene, polyvinylanthracene, polyvinylacridine, poly-9-vinylphenylanthracene, pyrene-formaldehyde resin, and ethylcarbazole formaldehyde resin.

Among them, the aromatic amine-type transporting agent and, particularly, the transporting agent represented by the general formula (3)

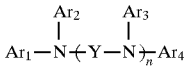

wherein $Ar_1$, $Ar_2$, $Ar_3$ and $Ar_4$ are each an aryl group, an alkaryl group or an aralkyl group, and n is zero or 1, and the carbazolehydrazone-type transporting agent and, particularly, the transporting agent represented by the general formula (4)

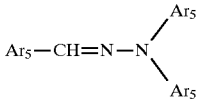

wherein $Ar_5$ may be the same or different, and is an alkaryl group or an aralkyl group, are preferred having good solubility and positive hole-transporting property.

In the single dispersion-type photosensitive material used in the present invention, it is desired that the charge-generating agent (CGM) is contained in the photosensitive layer in an amount of 1 to 7% by weight and, particularly, 2 to 5% by weight per a solid component and that the charge-transporting agent (CTM) is contained in the photosensitive layer in an amount of 20 to 70% by weight and, particularly, 25 to 60% by weight per a solid component.

From the standpoint of sensitivity and reversal development, furthermore, it is desired to use the electron-transporting agent (ET) and the positive hole-transporting agent (HT) in combination. In this case, it is best desired that the weight ratio of ET:HT is 10:1 to 1:10 and, particularly, 1:5 to 1:1.

The composition for forming the photosensitive material used in the present invention may be blended with a variety of widely-known blending agents, such as antioxidizing agent, radical-trapping agent, singlet quencher, UV-absorbing agent, softening agent, surface-reforming agent, defoaming agent, filler, viscosity-imparting agent, dispersion stabilizer, wax, acceptor, donor and the like in such amounts that they will not adversely affect the electrophotographic properties.

When a steric hindrant phenolic antioxidizing agent is blended in an amount of 0.1 to 50% by weight per the whole solid component, furthermore, the durability of the photosensitive layer can be markedly enhanced without adversely affecting the electrophotographic properties.

The electrically conducting drum that is to be provided with a photosensitive layer may be a blank tube composed of pure aluminum or an aluminum alloy. The drum may be treated with alumite such that the film thickness thereof is 1 to 50 $\mu$m.

The single-dispersion type photosensitive material is formed by preparing a charge-generating material, a charge-transporting material and a binder resin by a conventional method such as by using a roll mill, a ball mill, Atritor, a paint shaker or an ultrasonic dispersing machine, and applying them by using a conventional coating means followed by drying.

Though there is no particular limitation, it is desired that the photosensitive layer has a thickness of generally from 10 to 40 $\mu$m and, particularly, from 20 to 35 $\mu$m.

Various organic solvents can be used for forming a coating solution, such as alcohols like methanol, ethanol, isopropanol and butanol; aliphatic hydrocarbons like n-hexane, octane and cyclohexane; aromatic hydrocarbons like benzene, toluene and xylene; halogenated hydrocarbons like dichloromethane, dichloroethane, carbon tetrachloride and chlorobenzene; ethers like dimethyl ether, diethyl ether, tetrahydrofurane, ethylene glycol dimethyl ether, and diethylene glycol dimethyl ether; ketones like acetone, methyl ethyl ketone and cyclohexanone; esters like ethyl acetate and methyl acetate; as well as dimethylformamide and dimethyl sulfoxide. These solvents are used in one kind or being mixed together in two or more kinds. It is desired that the coating solution usually has a solid component concentration of from 5 to 50%.

[Electric Charging]

The charger means 2 used in the present invention is a scorotron charger which, as shown in FIG. 2, comprises a pair of shields 5 arranged being opposed to each other, a grid 6 disposed in the opening on the side of the photosensitive material drum 1, and a corona wire (discharge member) 7. The shields 5 are held in a housing 8 made of, for example, a resin, and a hole 4 is formed in the lower part of the housing 8 to be communicated with the interior of the charger 2.

As described already, the charger means 2 is disposed in the area (A) defined by the line (a) and the line (b) as shown in FIG. 1, and the ventilation opening 4 is formed in a particular portion of the charger means. Therefore, despite the apparatus is compact in size, the photosensitive material drum 1 is very little affected by ozone or NOx. Besides, even though the image is formed in a cleaningless manner, the toner is effectively prevented from adhering onto the corona wire 7 or the grid 6.

As for the size of the hole 4 formed in the charger means 2, it is desired that the hole 4 is formed over the whole length of the charger means 2 from the standpoint of ventilation. The width (W) of the opening is between the shields 5 and 5 at the greatest but should at least be not smaller than one-fifth of W.

Figure 3A:
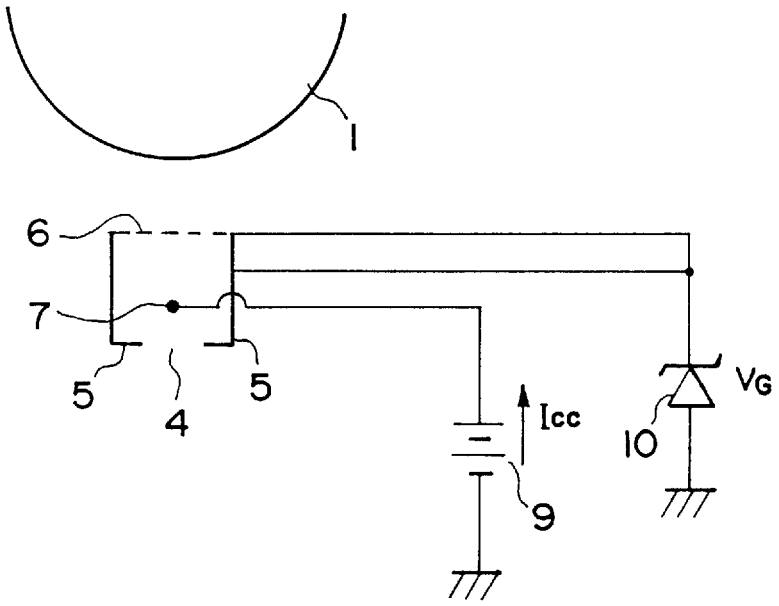
FIG. 3 is a diagram of electric connection of a charger.

Referring to FIG. 3(A), a discharge member 7 is electrically insulated from the shields 5 and the housing, and is connected to a high-tension source 9. The grid member 6 is electrically insulated from the shields 5 and the housing and is grounded through a Zener diode (constant-potential diode) or a varistor 10.

Figure 3B:
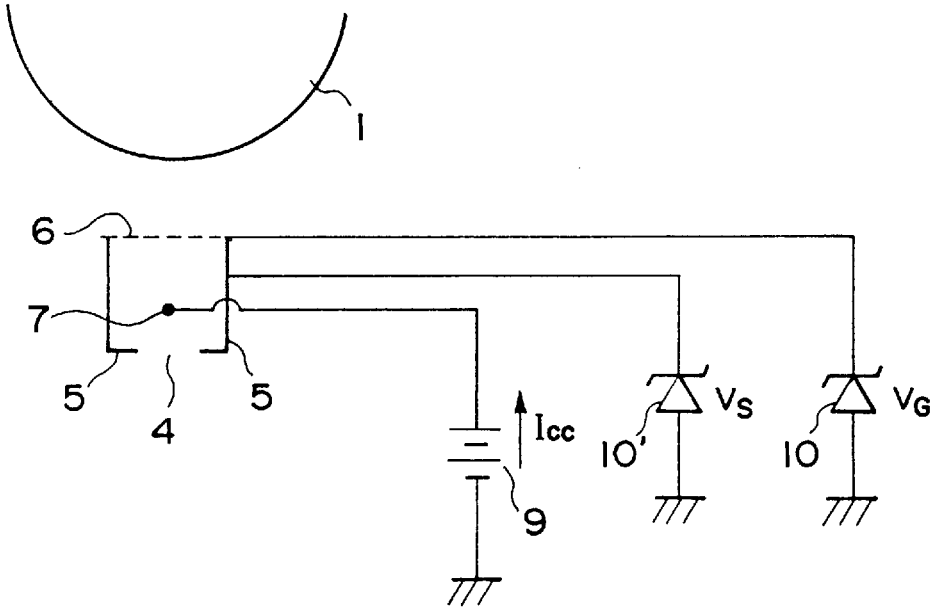

As shown in FIG. 3(B), furthermore, the grid member 6 and the shields 5 may be grounded through independent Zener diodes or varistors 10 and 10'.

In the scorotron charger, an electric current (Icc) that flows into the discharge member 7 is the sum of an effective charging current (Ipc) flowing into the photosensitive material 1, a current (Isc) flowing into the shields 5, and a current (Igc) flowing into the grid 6, i.e., expressed by the formula (I), $$Icc=Ipc+Isc+Igc \quad (I)$$

Usually, the current that flows into the discharge member of the corotron charger is given by the above formula (I) but in which the charging current (Igc) that flows to the grid member 6 is set to be zero.

In the scorotron charger used in the present invention, an electric field $E_1$ between the wire 7 and the grid 6 is set to be stronger than an electric field $E_2$ between the wire 7 and the shield 5. When the voltage of the wire is denoted by Vw, voltage of the grid by Vg, voltage of the shield by Vs, the distance between the wire and the grid by y, and the distance between the wire and the shield by x, then, the electric field $E_1$ is expressed by the following formula (II), $$E_1=|Vw-Vg|/Y \quad \text{(II)}$$

and the electric field $E_2$ is expressed by the following formula (III), $$E_2=|Vw-Vs|/X \quad \text{(III)}$$

Referring here to FIG. 3(A), when Vg=Vs, then, $E_1/E_2=X/y$, from which it will be understood that the above-mentioned conditions can be satisfied by setting y to be smaller than x. In the present invention, it is desired that $4>E_1/E_2>1$ and, particularly, $2\geqq E_1/E_2>1.2$.

Referring again to FIG. 3(B), the condition $E_1>E_2$ may be satisfied by using the diodes 10 and 10' having different constant voltages for the grid 6 and for the shields 5, i.e., by setting the constant voltages to be Vs>Vg.

Figure 4:
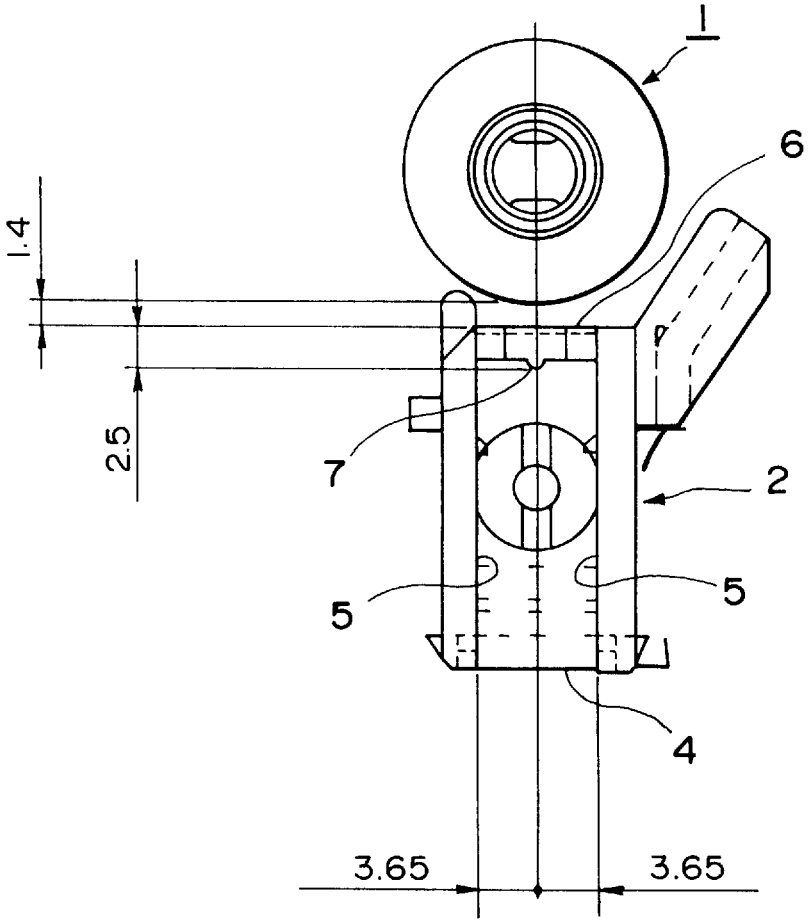
FIG. 4 is a diagram illustrating the sizes of the charger.

Referring to FIG. 4 illustrating a concrete example (Example that will be described later) for setting the electric field $E_1$ between the wire and the grid and for setting the electric field $E_2$ between the wire and the shield, the distance (y) between the wire and the grid has been selected to be 2.5 mm, the distance (x) between the wire and the shield has been selected to be 3.65 mm and, hence, the ratio of the field intensities ($E_1/E_2$) is 1.462. In this Example, the closest distance between the grid and the surface of the photosensitive material drum is 1.4 mm.

In the present invention, it is desired to so dispose the scorotron charger that the width of the opening which is on the side of the photosensitive material drum and is away by 0.5 to 3 mm from the surface of the photosensitive material drum, covers 10to 30% of the circumference of the photosensitive material drum, from the standpoint of preventing the image defect caused by leakage. Mentioned below is the reason why this helps prevent the image defect on the single-layer photosensitive material that is caused by leakage.

That is, in the single-layer organic photosensitive material, the causes of leakage are that the charge-generating agent is exposed on the surface and that in a drum having a diameter of not larger than 20 mm, the charging portion is concentrated in a very narrow region in the circumferential direction of the drum due to a large curvature and a heavy current flows. With the small-diameter drum and the scorotron charger having a particular opening width being combined together as contemplated by the present invention, however, the control grid acquires a constant potential and it is presumed that as the surface potential approaches thereto in the charging portion of the photosensitive layer, a discharge current (Ipc) to the above-mentioned portion of the photosensitive layer decreases to suppress the occurrence of leakage.

The small-diameter drum of the single-layer photosensitive material having a surface potential (Sp) maintained within a range of from 700 to 1000 volts is effective in forming an image maintaining a high density and a high contrast yet preventing the leakage. From the standpoint of preventing the leakage, on the other hand, the grid potential is usually maintained at 600 to 1300 volts and, particularly, from 700 to 1100 volts.

When the operation is conducted repetitively, a drop (ΔSp) in the surface potential of the single-layer photosensitive material after 100K pieces (1K=1000) reaches the order of 100 V in the case of the corotron charger and reaches the order of 60 V in the case of the scorotron charger of which the shield is grounded, and, hence, the image density drops conspicuously. When the shield is maintained at a high potential as shown in FIG. 3, however, the drop ΔSp can be suppressed to be smaller than 40 V.

The charging potential on the surface of the photosensitive material and the grid potential should be maintained within the above-mentioned ranges. For this purpose, the scorotron charger should be impressed with a positive voltage of from 3 KV to 7 KV.

The shield having a high electric resistance is also effective in preventing the image defect caused by the leakage. For this purpose, at least the surfaces of the shield should be coated with a resin having high electric resistance, such as olefin resin, fluorine-contained resin, vinyl chloride resin, epoxy resin or silicone resin.

The Zener diode or the varistor will be the one of which the grid can be maintained at a predetermined potential.

The Zener diode or the varistor does not almost permit the current to flow unless the voltage reaches a predetermined value but permits the current to flow suddenly when the predetermined voltage is exceeded. Thus, the Zener diode or the varistor works to hold the control grid and the shield of the charger at preset voltages and further works to decrease the charging current (Igc) that flows to the control grid and to decrease the charging current (sc) that flows to the shield.

It is allowable to provide a separate power source instead of the Zener diode or the varistor to apply a predetermined voltage, as a matter of course.

The grid will be in the form of parallel lines or a lattice having an opening area ratio of about 70 to 98%.

[Exposure to Light]

The image exposure means 20 according to the present invention may expose the photosensitive material after charged to the light by using a widely known laser beam or an array of light-emitting diodes (LEDs). The source of light 21 for exposure may use a source of monochromatic light such as red, yellow or green LEDs, or may use a source of laser beam such as semiconductor laser beam.

In this case, the amount of exposure ($I_B$) at the bright portion is such that the residual potential ($E_R$) at the bright portion is lower than the bias potential ($E_B$). More preferably, the amount of exposure is so set that the residual potential ($E_R$) at the bright portion satisfies the formula (II), $$E_R=E_B-nE_{DO} \quad \text{(II)}$$

wherein $E_B$ is a developing bias potential, $E_{DO}$ is a potential at which the fogging density becomes substantially zero concerning the developing sensitivity characteristics of the photosensitive material and the developing agent in combination, and n is a number of from 0.4 to 2.5.

[Developing]

The developing means 30 used in the present invention is a device for developing a one-component nonmagnetic toner. As shown in FIG. 2, the developing container 31 includes an elastic developing roller 32 for applying the nonmagnetic one-component toner onto the photosensitive material, a subroller 33 for feeding the toner to the developing roller, and an aggitator 34 for aggitating and electrically charging the toner. An opening 35 is formed in the developing container 31 on the side close to the photosensitive material, the developing roller 32 is located in the opening 35, and the subroller 33 is provided close to the developing roller 32.

On the upper portion of the developing container 31 is provided a toner cartridge 37 having a slit-like opening 36 at the lower end thereof, and a toner feed roller 38 is provided in the opening 36. Furthermore, a blade 39 is provided by the side of the elastic developing roller 32 on the side of feeding the toner layer, in order that the toner layer has a predetermined thickness and that the toner is electrically charged additionally.

The one-component toner 40 contained in the toner cartridge 37 is fed by a predetermined amount into the developing container 31 by the toner feed roller 38, agitated by the aggitator 34 and is electrically charged. The electrically charged toner is applied onto the subroller 33 and is then applied onto the elastic developing roller 32. The toner layer on the developing roller 32 is controlled to a predetermined thickness by the blade 39, and the toner on the developing roller 32 is strongly charged being rubbed by the blade.

The developing roller 32 is an electrically conducting elastic roller. The developing roller holding the one-component toner is brought into contact with the photosensitive drum 1 to form image by reversal developing. The reversal developing is effected in a manner that the charging polarity of the toner is the same as the charging polarity of a dark portion (unexposed portion) of the photosensitive material and that substantially no toner remains on the dark portion of the photosensitive material. The reversal developing is effectively carried out owing to the repulsion of the same polarity between the toner and the dark portion of the photosensitive material and owing to the attraction between the electric charge induced in the bright portion of the photosensitive material and the toner and, besides, the dark portion of the photosensitive material is effectively cleaned at the time of developing. It is desired that a bias voltage applied to the subroller 33 is slightly higher than a bias voltage applied to the developing roller 32, so that the toner smoothly migrates from the subroller 33 to the developing roller 32.

In the present invention, the nonmagnetic one-component toner can be obtained by, for example, the pulverization method, spray-dry method or the polymerization method. The toner contains a fixing resin, a coloring agent, a high-molecular or low-molecular charge control agent, a parting agent and the like agents. Preferably, furthermore, the toner comprises a single dispersion or particles close thereto having a median diameter of 3 to 20 $\mu$m and, particularly, 5 to 12 $\mu$m and in which the degree of dispersion of particle diameters represented by D25/D75 is not larger than 1.50 and, particularly, not larger than 1.40. In this specification, D25 and D75 represent particle diameters that correspond to 25% and 75% of the whole toner particles reckoned as volume.

Concretely described below is the toner of the polymerization method.

The spherical toner of the polymerization method is obtained by suspension-polymerizing a toner-forming composition which contains at least a radical polymerization initiator, a vinyl monomer capable of forming a fixing resin and a coloring agent in an aqueous medium.

The vinyl monomer capable of forming a fixing resin is insoluble in the water, and is capable of forming a thermoplastic resin having both the fixing property and the electroscopic property. Though there is no particular limitation, its suitable examples include vinyl aromatic monomer, acrylic monomers vinyl ester monomer, vinyl ether monomer, diolefin monomer and monoolefin monomer.

As the vinyl aromatic monomer, there can be exemplified vinyl aromatic hydrocarbons represented by the following formula (5),

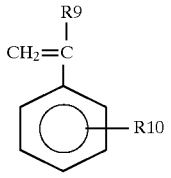

wherein R9 is a hydrogen atom, a lower alkyl group or a halogen atom, and R10 is a hydrogen atom, a lower alkyl group, a halogen atom, an alkoxy group, a nitro group or a vinyl group, such as styrene, α-methylstyrene, vinyltoluene, α-chlorostyrene, o-, m- or p-chlorostyrene, p-ethylstyrene and divinylbenzene which may be used in one kind or in a combination of two or more kinds.

The acrylic monomer may be represented by the following formula (6),

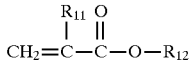

wherein $R_{11}$ is a hydrogen atom or a lower alkyl group, $R_{12}$ is a hydrogen atom, a hydrocarbon group having not more than 12 carbon atoms, a hydroxyalkyl group or a vinyl ester group, such as methyl acrylate, ethyl acrylate, butyl acrylate, 2-ethylhexyl acrylate, cyclohexyl acrylate, phenyl acrylate, methyl methacrylate, hexyl methacrylate, 2-ethylhexyl methacrylate, β-hydroxyethyl acrylate, γ-hydroxypropyl acrylate, δ-hydroxybutyl acrylate, β-hydroxyethyl methacrylate, ethylene glycol dimethacrylate ester, tetraethylene glycol dimethacrylate ester, and the like.

Other monomers may be vinyl esters such as vinyl formate, vinyl acetate, vinyl propionate; vinyl ethers such as vinyl-n-butyl ether, vinylphenyl ether, vinylcyclohexyl ether and the like; diolefins and, particularly, butadiene, isoprene and chloroprene; monolefins and, particularly, ethylene, propylene, isobutylene, butene-1, pentene-1, 4-methylpentene-1 and the like.

A preferred monomer may be a styrene monomer, an acrylic monomer or a styrene/acrylic monomer.

As coloring agents for the toner, use is made of inorganic or organic pigments or dyes. Suitable examples are as described below. It is desired that the coloring agents are used in amounts of 3 to 20% by weight with respect to the resin in the toner.

Black Pigment:

Carbon black, acetylene black, lamp black, Aniline Black.

Yellow pigment:

Chrome yellow, zinc yellow, cadmium yellow, yellow iron oxide, mineral fast yellow, nickel titanium yellow, naples yellow, Naphthol Yellow S, Hansa Yellow G, Hansa Yellow 10G, Benzidine Yellow G, Benzidine Yellow GR, Quinoline Yellow Lake, Permanent Yellow NCG, Tartrazine Lake.

Orange Pigment:

Chrome orange, molybdenum orange, Permanent Orange GTR, Pyrazolone Orange, Vulcan Orange, Indanthrene Brilliant Orange RK, Benzidine Orange G, Indanthrene Brilliant Orange GK.

Red Pigment:

Red iron oxide, cadmium red, red lead, cadmium mercury sulfide, Permanent Red 4R, Lithol Red, Pyrazolone Red, calcium salt of Watchung Red, Lake Red D, Brilliant Carmine 6B, eosine lake, Rhodamine Lake B, Alizarine Lake, Brilliant Carmine 3B.

Violet Pigment:

Manganese violet, Fast Violet B, Methyl Violet Lake.

Blue Pigment:

Prussian blue, cobalt blue, Alkali Blue Lake, Victoria Blue Lake, phthalocyanine blue, nonmetallic phthalocyanine blue, partial chloride of phthalocyanine blue, Fast Sky Blue, Indanthrene Blue BC.

Green Pigment:

Chromium green, chromium oxide, Pigment Green B, Malachite Green Lake, Final Yellow Green G.

White Pigment:

Zinc flower, titanium oxide, antimony white, zinc sulfide.

Extender Pigment:

Barite powder, barium carbonate, clay, silica, white carbon, talc, alumina white.

As the radical polymerization initiator, there can be used any known radical polymerization initiator such as azo compound, hydroperoxide, peroxide, peroxide-type initiator or redox initiator. Though there is no particular limitation, preferred examples of the initiator are as follows: i.e., 2,2'-azobisisobutylonitrile, 2,2'-azobis(2,4-dimethylvaleronitrile), 2,2'-azobis(2-cyclopropylpropionitrile), 2,2'-azobis(4-methoxy-2,4-dimethylvaleronitrile), 1,1'-azobis(1-cyclohexanecarbonitrile), benzoyl peroxide, (1-phenylethyl) azodiphenylmethane.

The composition for forming spherical toner may be blended with a known toner assistant which may be, for example, a charge control agent or a parting agent.

As the parting agent, there can be used polypropylene wax, polyethylene wax or an acid-modified product thereof, which can be contained in the size of emulsion particles in the composition for forming toner.

Any widely known charge control agent can be used such as oil-soluble dye like Nigrosine Base (CI 5045), Oil Black (CI 26150) or spiron black, which may be blended with a metal salt of naphthenic acid, a metal soap of fatty acid or a metal-containing complex dye. There can be further used a charge-controllable functional group-containing water-soluble monomer copolymerizable with the above-mentioned vinyl monomers. Examples of the monomer include radical polymerizable monomers having an electrolytic group such as anionic group of the type of sulfonic acid, phosphoric acid or carboxylic acid, or such as cationic group like primary, secondary or tertiary amino group or quaternary ammonium group. Suitable examples include styrenesulfonic acid, sodium styrenesulfonate, 2-acrylamide-2-methylpropane sulfonate, 2-acid phosphoxypropyl methacrylate, 2-acid phosphoxyethyl methacrylate, 3-chloro-2-acid phosphoxypropyl methacrylate, acrylic acid, methacrylic acid, fumaric acid, crotonic acid, tetrahydroterephthalic acid, itaconic acid, aminostyrene, aminoethyl methacrylate, aminopropyl acrylate, diethylaminopropyl acrylate, γ-N-(N,N'-diethylaminoethyl) aminopropyl methacrylate, and trimethylammoniumpropyl methacrylate.

It is further possible to introduce the charge control group into the polymer terminals by using a radical initiator having an electrolytic group such as anionic group of the type of sulfonic acid, phosphoric acid or carboxylic acid or cationic group like primary, secondary or tertiary amino group or quaternary ammonium group.

To produce the toner by the polymerization method, the composition for forming toner containing a vinyl monomer and the like is suspended in the water. In this case, the concentration of the composition is generally from 1 to 50% by weight and, particularly, from 5 to 30% by weight, and it is desired to adjust the size of the suspended particles to be generally from 3 to 20 μm and, particularly, from 5 to 12 μm.

As required, a dispersion stabilizer may be used to stabilize the state of suspension of the composition for forming toner. Examples of the dispersion stabilizer will be high-molecular compounds such as polyvinyl alcohol, methyl cellulose, ethyl cellulose, polyacrylic acid, polyacrylamide, polyethylene oxide, poly(hydroxystearic acid-g-methyl methacrylate-CO-methacrylic acid) copolymer, nonionic or ionic surfactant, inorganic powder such as calcium phosphate, that dissolves in the medium. It is desired that the dispersion stabilizer is added to the system in an amount of from 0.1 to 10% by weight and, particularly, from 0.5 to 5% by weight.

It is desired that the amount of the initiator in the composition for forming toner is from 0.3 to 30% by weight and, particularly, from 0.5 to 10% by weight based on the monomer.

To carry out the polymerization, the reaction system is substituted with an inert gas such as nitrogen, and the polymerization is carried out at a temperature of from 40° to 100° C. and, particularly, from 50° to 90° C. while maintaining the above-mentioned suspended state. It is, of course, allowable to mildly execute the agitation in order to homogenize the reaction system.

The polymerization product after the reaction is obtained as particles of sizes lying within the above-mentioned range. Therefore, the formed particles are filtered and are, as required, washed with water or a suitable solvent, followed by drying to obtain toner particles.

As required, the toner particles are blended with a fluidity-improving agent such as carbon black, hydrophobic fine amorphous silica, hydrophobic fine alumina or fine titanium oxide in order to obtain a final toner. It is desired to use the fluidity-improving agent in an amount of 0.1 to 2% by weight with respect to the toner.

In order to improve fluidity, heat resistance and offset resistance of the toner obtained by the polymerization method, it is desired that the resin in the toner has a gel permeation chromatogram (GPC) having a peak value of high-molecular weight in a range of molecular weight of from 50,000 to 500,000 and a peak value of low-molecular weight in a range of molecular weight of from 1,000 to 50,000. The molecular weight can be adjusted by the seeding polymerization or the like method.

The elastic developing roller 32 is made of a composition of an elastomer polymer which is blended with an electrically conducting powder.

The surface resistance of the elastic developing roller should be generally from $10^5$ to $10^{12}$ Ω·cm and, particularly, from $10^7$ to $10^{10}$ Ω·cm. When the surface resistance exceeds the above range, it becomes difficult to apply the bias voltage. When the surface resistance is smaller than the above range, on the other hand, leakage tends to occur due to electric discharge on the surface of the photosensitive material.

It is further desired that the surface hardness (Rockwell JIS A) of the elastic developing roller is from 30 to 70 and, particularly, from 40 to 60. When the surface hardness is higher than the above range, it becomes difficult to bring the toner layer into uniform contact with the surface of the photosensitive material and the photosensitive material tends to be worn out. When the surface hardness is lower than the above range, on the other hand, it becomes difficult to transmit the contacting force to a sufficient degree and the developing roller tends to be worn out.

As the elastomer polymer, there can be used, for example, nitrile-butadiene rubber (NBR), styrene-butadiene rubber (SBR), chloroprene rubber (CR), polybutadiene (BR), poly-isoprene (IIB), butyl rubber, natural rubber, ethylene-propylene rubber (EPR), ethylene-propylene-diene rubber (EPDM), polyurethane, silicone rubber, fluorine-contained rubber, polyethylene chloride, polypropylene chloride or soft vinyl chloride resin. The surface hardness can be adjusted by using a foaming material (sponge) or by being blended with a plasticizer or a softening agent.

As the electrically conducting powder, there can be used, electrically conducting carbon black, a metal powder such as of, copper, silver, aluminum or tin oxide doped with indium or antimony. Among them, however, the electrically conducting carbon black is preferred. The electrically conducting powder may be contained in such an amount that the electric resistance and the hardness of the roller lie within the above-mentioned ranges.

The electrically conducting rubber roller is formed by blending a known blending agent such as sulfur-type or organic curing agent, cure-promoting agent, softening agent, anti-aging agent, filler, dispersing agent, plasticizer and foaming agent in amounts that have been known. The rubber roller after molded is heated, cured or cure-foamed, in order to obtain an elastic developing roller having a predetermined hardness.

The present invention can be advantageously adapted to an organic photosensitive material drum having a relatively small diameter, for example, to an organic photosensitive material drum having an outer diameter (Dp) of from 10 to 20 mm. It is desired that the elastic developing roller has an outer diameter (Dd) of from 6.5 to 20 mm and, particularly, from 7.0 to 16 mm, and that the ratio (Dd/Dp) of the diameter of the organic photosensitive material drum to the diameter of the elastic developing roller is from 65 to 100%.

In carrying out the developing, it is desired that the elastic roller is brought into contact with the photosensitive material under a line pressure of 0.05 to 1 kg/dm and, particularly, 0.08 to 0.5 kg/dm, and that the peripheral velocity of the elastic roller is 1.2 to 3 times as fast and, particularly, 1.5 to 2.5 times as fast as the peripheral velocity of the photosensitive material at the nip position and in the same direction.

When the contact force is smaller than the above-mentioned range or when the peripheral velocity of the elastic developing roller is lower than the above-mentioned range, it becomes difficult to increase the density of the image to a sufficient degree, and the dark portion of the photosensitive material is not cleaned to a sufficient degree. When the contact force is larger than the above-mentioned range or when the peripheral velocity of the elastic developing roller is higher than the above-mentioned range, the photosensitive material is ground in an increased amount causing the life to be shortened.

It is desired that the elastic roller is applied with a bias potential which is of the same polarity as the charging potential of the toner and is from 0.2 to 0.8 times and, particularly, from 0.3 to 0.7 times as the potential (at the dark portion) of the photosensitive material. When the bias potential is lower than the above-mentioned range, a sufficient degree of the image density is not obtained. When the bias potential is higher than the above-mentioned range, on the other hand, the toner at the dark portion of the photosensitive material is not cleaned to a sufficient degree or fogging takes place. Furthermore, the toner is not fed in sufficient amounts and the image density decreases.

In the developing apparatus shown in FIG. 2, it was pointed out already that a bias voltage is applied even to the subroller. Here, it is desired that the bias voltage applied to the subroller has the same polarity as the bias voltage applied to the elastic developing roller and is higher by about 0 to 200 volts than the bias voltage applied to the elastic developing roller from the standpoint of smoothly migrating the toner from the subroller to the elastic developing roller.

The thickness of the toner layer on the elastic developing roller is limited by the blade. Desirably, in general, the thickness of the toner layer is limited to be about twice the diameter of the toner particles; i.e., the toner layer is formed in a thickness of about two layers.

[Transfer of Toner]

According to the present invention, an electrically conducting elastic roller is used as the transfer means 45, and the photosensitive material drum 1 and the transfer roller 45 are disposed being separated away from each other by a small distance which is larger than the thickness of the transfer material 47, so that the toner can be transferred to the transfer material 47.

As the electrically conducting elastic material, the materials described concerning the developing roller are usually used; i.e., there is used a roller made of an electrically conducting polyurethane rubber composition which is cured to have a rubber hardness of larger than 50° (JIS A) and, preferably, larger than 70°. This makes it possible to prevent the occurrence of image defects such as white spot, and to transfer and form the image favorably and stably over extended periods of time.

The polyurethane rubber contains, in the polymer chain thereof, a soft segment based upon a polyester or a polyether and a hard segment based upon an aromatic chain bonded via an urethane or a urea bond and, hence, exhibits rubbery elasticity.

The polyurethane rubber used for the elastic transfer roller is obtained by reacting a chain extender (crosslinking agent) with a polyurethane prepolymer (isocyanate-terminated polymer) that is obtained by reacting a polyol (hydroxyl group-terminate d polymer) with a polyisocyanate compound. In this case, a desired rubber hardness is obtained by adjusting the reaction of the isocyanate-terminated prepolymer with the chain extender. A polyurethane having a desired hardness is obtained by adjusting, for example, the temperature and/or the reaction time of the chain extension (crosslinking) reaction. In general, the rubber hardness increases with a rise in the temperature and with an increase in the reaction time.

That is, the free isocyanate group in the prepolymer reacts with the chain extender (crosslinking agent) to form a urea bond which contributes to increasing the molecular weight of the polyurethane, and further reacts with the existing urethane bond or the urea bond to form an allophanate bond or buret bond thereby to form a three-dimensional crosslinked structure which helps increase the rubber hardness and makes it possible to obtain desired effects of the present invention as well as to improve wear resistance, heat resistance and durability.

The polyol used for forming the prepolymer has two or more active hydrogen atoms and, preferably, 2 to 3 active hydrogen atoms in one molecule thereof. Examples include polyether polyol, polyester polyol, polyacrylic polyol, polyvinyl polyol which may be used in one kind or in a combination of two or more kinds. A polyester polyol is desired from the standpoint of electric characteristics and durability, i.e., a polyester polyol which has been widely known in the production of polyester polyurethane is used.

Among them, a desired polyester polyol comprises a diol and a dicarboxylic acid, and is obtained by suitably reacting at least one or more of aliphatic diols with at least one or more of aliphatic carboxylic acids. Furthermore, the polyester polyol may contain polyester components such as polycaprolactam obtained by the ring-opening-polymerization.

Preferred examples of the aliphatic diol component include 1,2-propanediol, 1,3-propanediol, 1,3-butanediol, 1,4-butanediol, 1,5-pentanediol, 1,6-hexanediol, 1,8-octanediol, 1,10-decanediol, neopentyl glycol, ethylene glycol, diethylene glycol, polyethylene glycol, dipropylene glycol, polypropylene glycol, 1,4-cyclohexane methanol, 1,4-cyclohexanediol, 3-methyl-1,5-pentanediol, and the like.

Examples of the aliphatic carboxylic acid include malonic acid, succinic acid, glutaric acid, adipic acid, pimelic acid, suberic acid, azelaic acid, sebacic acid, decanedicarboxylic acid, dodecanedicarboxylic acid, 1,3-cyclohexanedicarboxylic acid, 1,4-cyclohexane dicarboxylic acid and the like acids.

It is desired that the hydroxyl group-terminated polymer has a number average molecular weight of from 300 to 10,000 and, particularly, from 1,000 to 8,000.

As the polyisocyanate compound, use is made of polyisocyanate compounds that have been widely known in the production of polyurethanes. Among them, it is desired to use a diisocyanate such as tolylene diisocyanate, 4,4-diphenylmethane diisocyanate, xylylene diisocyanate, naphthalene diisocyanate, paraphenylene diisocyanate, tetramethylxylylene diisocyanate, hexamethylene diisocyanate, dicyclohexylmethane diisocyanate, isophorone diisocyanate and tolidine diisocyanate. In particular, 4,4-diphenylmethane diisocyanate, xylylene diisocyanate, isophorone diisocyanate and hexamethylene diisocyanate are preferably used.

In producing the prepolymer, one or two or more kinds of polyols and one or two or more kinds of polyisocyanate compounds are so blended that the ratio NCO/OH is 1.1 to 4 and, preferably, 1.3 to 2.5, and are reacted together being heated at 60° to 130° C. for several hours to produce a polyurethane prepolymer.

As the chain extender (crosslinking agent), there can be used a polyfunctional active hydrogen-containing compound and, particularly, low-molecular polyols, low-molecular polyamines and, particularly, aliphatic or aromatic polyamines.

Preferred examples of the chain extender (crosslinking agent) include aliphatic diol components such as 1,2-propanediol, 1,3-propanediol, 1,3-butanediol, 1.4-butanediol, 1,5-pentanediol, 1,6-hexanediol, 1,8-octanediol, 1,10-decanediol, neopentyl glycol, ethylene glycol, diethylene glycol, polyethylene glycol, dipropylene glycol, polypropylene glycol, 1,4-cyclohexane methanol, 1,4-cyclohexanediol, 3-methyl-1,5-pentanediol and the like.

As the aliphatic diamine components, there can be desirably used 1,2-propaneamine, 1,3-propanediamine, 1,3-butanediamine, 1,4-butanediamine, 1,5-pentanediamine, 1,6-hexanediamine, 1,8-octanediamine, 1,10-decanediamine, neopentyldiamine, ethylenediamine, 1,4-cyclohexanediamine, 3-methyl-1,5-pentanediamine and the like.

As the aromatic polyamine, there can be exemplified tolylenediamine, 4,4-diphenylmethanediamine, xylylenediamine, naphthylenediamine, paraphenylenediamine, tetramethylxylenediamine, dicyclohexylmethanediamine, isophoronediamine, tolidinediamine and the like.

The chain extension (crosslinking) reaction is usually carried out by selecting the temperature and the reaction time from the temperature range of from 100° C. to 300° C. and from the reaction time of from 0.5 to 5 hours, such that a polyurethane having a desired hardness is obtained.

As the transfer roller, use is made of a roller made of a composition of a polyurethane blended with an electrically conducting powder. Prior to effecting the crosslinking, the composition of the prepolymer and the chain extender (crosslinking agent) is blended with the electrically conducting powder uniformly and homogeneously. It is desired that the electrically conducting rubber has a volume resistivity of generally from $10^7$ to $10^{14}$ Ω·cm and, particularly, from $10^8$ to $10^{12}$ Ω·cm.

The electrically conducting powder are those described concerning the electrically conducting elastic developing roller, and is blended in such an amount that the above-mentioned electric resistance and hardness are obtained.

To transfer the toner, the transfer roller is applied with a direct voltage of a polarity opposite to the main charging polarity of the photosensitive material. The direct voltage may be smaller than a charge start voltage of the photosensitive material or may be larger than the charge start voltage of the photosensitive material. From the standpoint of transfer efficiency, however, the latter transfer system is preferred. The charge start voltage ($V_{TH}$) of the photosensitive material using the transfer roller varies depending upon the kind of the photosensitive material. In the case of a single dispersion layer-type organic photosensitive material preferably used in the present invention, however, the charge start voltage ($V_{TH}$) is from about 0.3 to about 2 KV. An application voltage which is desirable from the standpoint of toner transfer efficiency is not smaller than 1.5 times and, particularly, not smaller than 2 times of the charge start voltage ($V_{TH}$) of the photosensitive material.

On the other hand, the upper limit of the voltage applied to the transfer roller is determined by the surface potential (residual potential of before the main charging) of the photosensitive layer after the electric charge has been removed. It is desired that the application voltage is so set that the absolute value of the residual potential of before the main charging is not larger than 50 V and, preferably, not larger than 20 V.

[Removal of Foreign Matters]

In the present invention, means 30 which effects the developing also works to clean the toner remaining on the photosensitive material. Therefore, the so-called cleaning mechanism is not provided, and the toner remaining on the photosensitive material is used again for the developing. However, the photosensitive drum comes into contact with the transfer material such as paper, and foreign matter such as paper dust may adhere on the surface of the photosensitive material. In order to remove the foreign matter, the foreign matter-removing means 50 must be provided.

As the foreign matter-removing means 50, a fur brush is used; i.e., the brush fiber is at least partly constituted by an electrically conducting material such as metal in order to remove electricity from the photosensitive material at the same time.

In the present invention, the toner is fixed by using a known means under known conditions.

[Image-Forming Unit]

Figure 5:
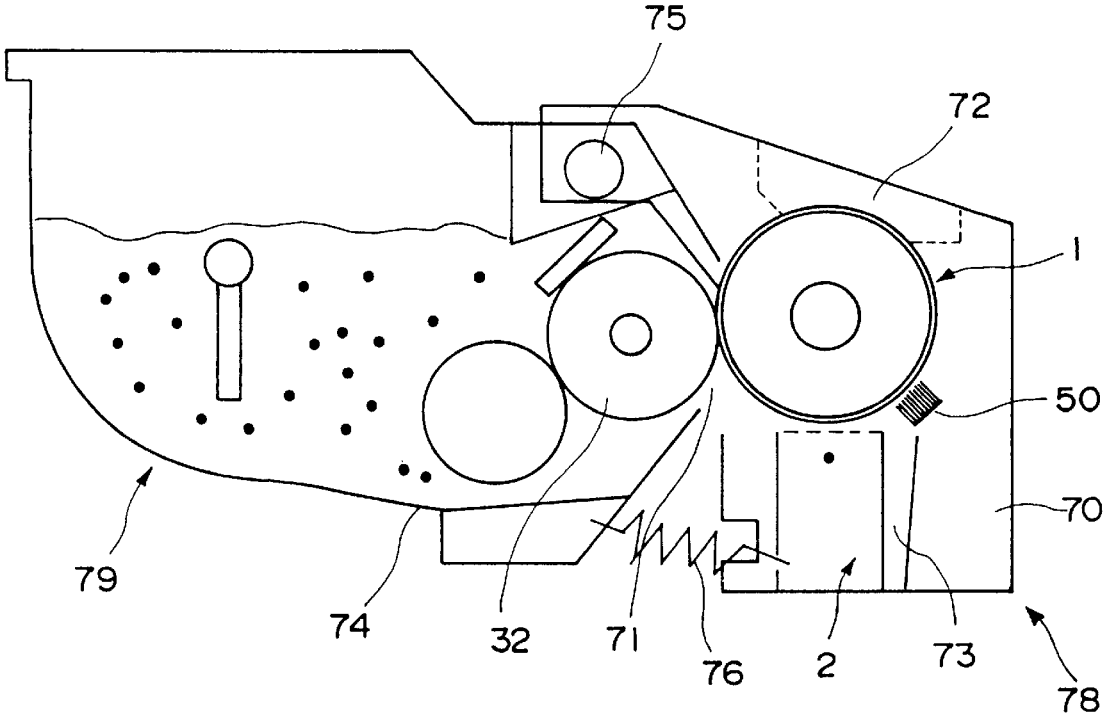
FIG. 5 is a diagram of arrangement illustrating an image-forming unit used in the present invention.

According to the present invention as shown in FIG. 5, the photosensitive material drum 1, charging means 2 and foreign-matter removing means 50 are mounted on a frame 70 to fabricate a photosensitive material unit 78, which is advantageous in replacing the photosensitive material on the site of servicing and in adjusting the positions of the photosensitive material and various means. The frame 70 has an opening 71 formed in the side surface thereof to permit the photosensitive material drum 1 to come into contact with the developing means 32, and further has an opening 72 formed in the upper surface thereof to permit the transfer means 45 to approach the photosensitive material drum 1. There may be further provided means 73 for expelling foreign matter such as paper dust or the like removed by the foreign matter-removing means 50 (see FIG. 2).

The developing means 32 is supported by a second frame 74 which also serves as a toner container thereby to constitute a developing unit 79. The first frame 70 and the second frame 74 are detachably provided in the image-forming unit by a common fulcrum 75 in a manner that at least either one of them is allowed to swing. The photosensitive material drum and the developing means are engaged with each other by a resilient engaging means 76 on the side opposite to the fulcrum 75.

[EXAMPLES]

The invention will now be described by way of the following examples.

(Preparation of a Single-layer Dispersion-Type Organic Photosensitive Material Drum)

| Components: | |
|---|---|
| Metal-free phthalocyanine (charge-generating material) | 5 parts by weight |
| N,N'bis(O,P-dimethylphenyl)-N,N'-diphenyl benzidine (positive hole-transporting material) | 40 parts by weight |
| 3,3',5,5'-tetraphenyldiphenoquinone (electron-transporting material) | 40 parts by weight |
| Polycarbonate (binder resin) | 100 parts by weight |
| Dichloromethane (solvent) | 800 parts by weight |

The above components were mixed and dispersed by using a ball mill, and the resulting coating solution was applied onto aluminum blank tubes having diameters of 16 mm and 10 mm by the dip-coating method followed by hot-air drying at 60° C. for 60. minutes to obtain single-layer dispersion-type organic photosensitive materials having a film thickness of 30 $\mu$m.

A copier LDC-650 manufactured by Mita Kogyo Co. was modified to be suited for the experiment of the present invention.

Figure 6:
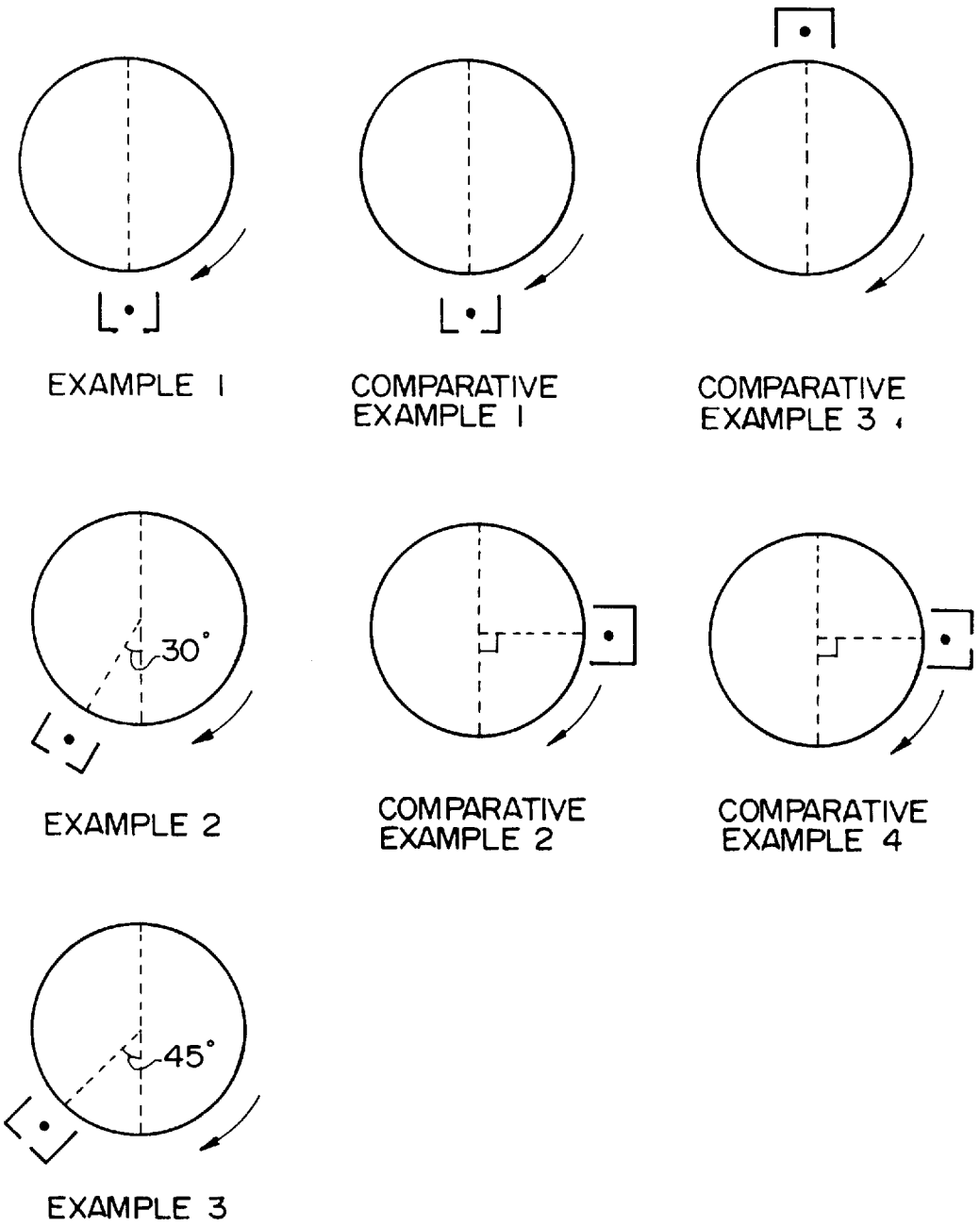
FIG. 6 is a diagram illustrating the arrangements of a scorotron charger according to Examples 1 to 3 and Comparative Examples 1 to 4.

That is, as shown in FIG. 6, the scorotron charger (the size is as shown in FIG. 4) having grid was disposed at different positions (Examples 1 to 3, Comparative Examples 1 to 4).

Though not shown in FIG. 4, the nonmagnetic one-component toner developer of the type that is contacted to the developing roller, noncontact-type transfer roller (maintaining a gap of 0.3 mm relative to the photosensitive drum), and a foreign matter-removing brush for recovering foreign matter on the photosensitive material drum, were arranged on the downstream side of the scorotron charger in the direction of rotation of the photosensitive material drum.

The scorotron chargers used in Examples 1 to 3 and in Comparative Example 4 possessed a hole, but the scorotrons used in Comparative Examples 1 to 3 did not possess a hole.

By using the above-mentioned apparatuses, 500 pieces of images were continuously formed at a peripheral velocity of the photosensitive material drum of 56 mm/sec. After an interval of 60 minutes, 500pieces of images were continuously formed again to obtain a total of 1000 pieces of sample images. The image of the final thousandth piece was evaluated by naked eyes. The results were as described below.

In Examples 1 to 3, favorable images were obtained by the drums.

In Comparative Example 1, black stripes occurred extending in a direction corresponding to the circumferential direction of the drum probably due to poor electric charging.

In Comparative Example 2, black strips occurred like those of Comparative Example 1, and local background fogging occurred, too, in the portions corresponding to the axial direction of the drum. The background fogging is presumably due to local oxidation on the surface of the photosensitive material being caused by ozone and NOx.

In Comparative Example 3, the background fogging was observed like the one exhibited in Comparative Example 2.

In Comparative Example 4, black stripes and background fogging were observed like those in Comparative Example 2.

In the present invention in which the main charger is disposed on the lower side of the photosensitive material, the effects of the discharge-formed products (having specific gravities larger than that of the air) such as of ozone and NOx upon the surface of the photosensitive material can be avoided. At the same time, a hole is formed on the side opposite to the opening for charging to form an air passage passing through the charger. Therefore, the discharge-formed products are permitted to quickly flow down and the toner which is flying is also permitted to flow out through the hole, and the toner is prevented from adhering onto the corona wire or the like members.

When the main charger is provided on the lower side of the photosensitive material and when the drum has a small diameter, the transfer means is positioned on the upper side of the photosensitive material. According to the present invention, however, the transfer means is based on the roller charging instead of the corona charging, and no corona discharge takes place on the upper side of the photosensitive material, and the effects of the discharge-formed products are more reliably precluded.

Furthermore, the transfer is effected by the roller charging of the non-contact type. Besides, since the back-surface transfer is employed, the contact between the photosensitive material supporting the toner and the transfer roller is shut off by the paper. Even when the transfer operation is not carried out, the transfer roller is separated away from the photosensitive material supporting the toner. Therefore, the transfer roller is not contaminated and the back surface of the transfer paper is not contaminated, either. This is particularly important when printing on both surfaces of the paper.

Use of the non-contact type roller does not push the transfer paper onto the photosensitive material, and white spots are not formed on the characters and the image quality is markedly improved.

With the transfer means being provided on the upper side of the photosensitive material, the length of the conveyer passage can be minimized between the paper-feeding means placed on the upper part of the apparatus and the printed matter-discharging means, making it possible to fabricate the apparatus in a very compact size.

The photosensitive material drum and the charging means are mounted on a first frame to constitute a photosensitive material unit, the developing means is mounted on a second frame which also serves as a toner container to constitute a developing agent unit, and provision is made of a common fulcrum and a resiliently engaging means for the first frame and for the second frame, so that the developing means and the photosensitive drum are reliably engaged. Moreover, the image-forming unit is simply constituted, and can be very easily detached from, or attached to, the apparatus.

The present invention exhibits markedly enhanced effects particularly when the positively-charging type organic photosensitive material is a single-layer dispersion-type organic photosensitive material. That is, employment of the positively-charging type organic photosensitive material makes it possible to use positive corona and, hence, to decrease the generation of ozone compared to when negative corona is used. On the other hand, the organic photosensitive material and, particularly, the single-layer dispersion-type organic photosensitive material is more affected by the discharge-formed products than the inorganic photosensitive materials. According to the present invention, however, the arrangement of the abovementioned means makes it possible to decrease the effects of the discharge-formed products to a considerable degree.

An electric field $E_1$ between a wire and a grid in the scorotron charger is set to be stronger than an electric field $E_2$ between the wire and a shield, and the efficiency for electrically charging the photosensitive material is improved. That is, a small current (Icc) flows into the charging wire compared to the case of $E_1<E_2$ and, hence, the amount of the discharge-formed products decreases. At the time of charging, furthermore, the fresh air flows in through the ventilation hole formed in the shield, and the air in the charger is quickly substituted with the fresh air.

We claim:

1. An image-forming apparatus for forming an image comprising means for electric charging of a photosensitive material drum, means for exposure to light, means for developing and a transfer member for transferring a toner image formed on the photosensitive material drum to a transfer paper, wherein the means for developing also works to clean a toner remaining on the photosensitive material drum;

the means for electric charging has a scorotron charger which is located within ±45° from a perpendicular downwardly drawn from a center of the photosensitive material drum, and has a hole on the side opposite to an opening for charging;

an electric field $E_1$ between a wire and a grid in said scorotron charger is set to be stronger than an electric field $E_2$ between the wire and a shield; and the photosensitive material drum rotates a plurality of times in order to form the image on one transfer paper.

2. An image-forming apparatus according to claim 1, wherein the photosensitive material is a positively charging single-layer organic photosensitive material.

3. An image-forming apparatus according to claim 1 or 2, wherein said developing means is a reversal developing means using a one-component toner.

4. An image-forming apparatus according to claim 1, wherein said transfer member comprises a charging roller which does not contact with the photosensitive material drum, and the toner image formed on the photosensitive material drum is transferred onto the lower surface of the transfer paper.

5. An image-forming apparatus including an image-forming unit, wherein the apparatus comprises means for electric charging of a photosensitive material drum having an organic photosensitive layer, means for exposure to light, means for developing and a transfer member for transferring a toner image formed on the photosensitive material drum to a transfer paper, wherein the photosensitive material drum rotates a plurality of times in order to form the image on one transfer paper;

said image-forming unit comprising a first frame on which the photosensitive material drum and the means for electric charging are mounted, and a second frame on which the means for developing is mounted, the second frame including a toner container, the means for electric charging is a scorotron charger which is located with ±45° from a perpendicular downwardly drawn from a center of the photosensitive material drum and has a hole on the side opposite to an opening for charging;

the first frame and the second frame have a common fulcrum and are connected each other with a resiliently engaging means on the side opposite to the fulcrum; and an electric field $E_1$ between a wire and a grid in the scorotron charger is set to be stronger than an electric filed $E_2$ between the wire and a shield.

6. An image-forming apparatus according to claim 1, further having a cleaning member separate from the means for developing.

7. An image-forming unit according to claim 5, wherein a cleaning member is mounted on the first frame.

8. An image-forming apparatus for forming an image comprising means for electric charging of a photosensitive material drum, means for exposure to light, means for developing and a transfer member for transferring a toner image formed on the photosensitive material drum to a transfer paper, wherein the means for developing which after developing also works to clean off toner remaining on the photosensitive material drum;

the means for electric charging has a scorotron charger located within ±45° from a perpendicular downwardly drawn from a center of the photosensitive material drum, said charger including an opening disposed in proximity to and opposite the photosensitive material drum for charging the photosensitive material drum, a grid disposed across said opening and a wire disposed below said grid and contained in said charger and shielded by a shield surrounding said wire, said charger further including an air ventilation hole on the side opposite to the opening for charging for removal of ozone and NOx developed during charging; and an electric field $E_1$ between the wire and the grid in said scorotron charger is set to be stronger than an electric field $E_2$ between the wire and the shield; and the photosensitive material drum rotates a plurality of times in order to form the image on one transfer paper.

9. An image-forming apparatus according to claims 8, wherein the photosensitive material is a positively charging single-layer organic photosensitive material.

10. An image-forming apparatus according to claim 8, wherein said developing means is a reversal developing means using a one-component toner.

11. An image-forming apparatus according to claim 8, wherein said transfer member is disposed above said photosensitive material drum and away from the charger and comprises a charging roller which does not contact the photosensitive material drum, and paper onto which the toner image is transferred and the toner image formed on the photosensitive material drum is transferred onto the lower surface of the transfer paper.

* * * * *